US005271835A

United States Patent [19]

Gorawara et al.

[11] Patent Number: 5,271,835

[45] Date of Patent: Dec. 21, 1993

[54] PROCESS FOR REMOVAL OF TRACE POLAR CONTAMINANTS FROM LIGHT OLEFIN STREAMS

[75] Inventors: Jayant K. Gorawara, New City, N.Y.; Henry Rastelli, New Fairfield, Conn.; John Markovs, Yorktown Heights, N.Y.

[73] Assignee: UOP, Des Plaines, Ill.

[21] Appl. No.: 884,509

[22] Filed: May 15, 1992

[51] Int. Cl.[5] ..... C10G 19/02; C10G 25/05; C10G 25/12

[52] U.S. Cl. ..... 208/228; 208/203; 208/229; 208/236; 208/250; 208/301; 208/305; 210/674; 585/823; 585/824

[58] Field of Search ..... 208/203, 228, 229, 236, 208/250, 300, 301, 302, 305, 310 Z; 210/674; 568/697; 585/823, 824

[56] References Cited

U.S. PATENT DOCUMENTS

| | | | |
|---|---|---|---|
| 2,720,547 | 10/1955 | Wolff et al. | 260/614 |
| 2,918,426 | 12/1959 | Quiguerez | 208/206 |
| 2,966,453 | 12/1960 | Gleim et al. | 208/206 |
| 3,252,892 | 5/1966 | Gleim | 208/206 |
| 3,306,945 | 2/1967 | Conviser | 585/823 |
| 3,816,975 | 6/1974 | Collins | 55/33 |
| 3,922,217 | 11/1975 | Cohen et al. | 208/299 |
| 3,980,582 | 9/1976 | Anderson, Jr. et al. | 252/428 |
| 4,219,678 | 8/1980 | Obenaus et al. | 568/697 |
| 4,290,913 | 9/1981 | Frame | 252/428 |
| 4,404,118 | 9/1983 | Herskovits | 502/53 |
| 4,575,566 | 3/1986 | Vora | 568/697 |
| 4,808,765 | 2/1989 | Pearce et al. | 585/860 |
| 4,897,180 | 1/1990 | Bricker et al. | 208/189 |
| 5,081,325 | 1/1992 | Haynal et al. | 585/820 |
| 5,120,881 | 6/1992 | Rosenfeld et al. | 568/697 |
| 5,188,725 | 2/1993 | Harandi | 208/67 |

FOREIGN PATENT DOCUMENTS 222347 7/1968 U.S.S.R. .

OTHER PUBLICATIONS

Handbook of Petroleum Refining Processes, Edited by R. A. Meyers, pp. 9.3-9.13, 1-3 to 1-28, McGraw Hill Book Company, New York, 1986.

Huls-Process: Methyl Tertiary Butylether—Presented at The American Institute of Chemical Engineers, 85th National Meeting on Jun. 4-8, 1978, by Obenaus et al.

*Primary Examiner*—Theodore Morris
*Assistant Examiner*—Walter D. Griffin
*Attorney, Agent, or Firm*—Thomas K. McBride; John G. Tolomei; Richard P. Silverman

[57] ABSTRACT

A process is disclosed for improving catalyst performance and yields in the manufacture of motor gasoline components. More particularly the process is directed to the removal of $H_2S$, sulfur compounds, trace amounts of acetonitrile or acetone or propionitrile from a hydrocarbon feedstock, comprising a $C_3$-$C_5$ product fraction from a fluid catalytic cracking unit which may be used subsequently in an etherification process for the production of ethers such as MTBE and TAME and/or an alkylation process for the production of alkylate. The hydrocarbon feedstock is passed to an amine treating zone, a mercaptan sulfur removal zone and an adsorption zone for the removal of sulfur compounds, water and trace amounts of acetonitrile or acetone or propionitrile. The regeneration of the adsorption zone includes the contacting of the sorbent with a heated regenerant vapor stream. The spent regenerant vapor stream is condensed to provide a hydrocarbon phase and an aqueous phase. The trace amounts of the acetonitrile, acetone, and propionitrile are removed in the aqueous phase. The hydrocarbon phase is treated to remove sulfur compounds and can be recycled as the regenerant.

18 Claims, 2 Drawing Sheets

PROCESS FOR REMOVAL OF TRACE POLAR CONTAMINANTS FROM LIGHT OLEFIN STREAMS

FIELD OF THE INVENTION

This invention relates to a process for the removal of trace polar compounds and specifically acetonitrile and acetone from a feedstream derived from a fluid catalytic cracking (FCC) unit containing $C_3$–$C_5$ hydrocarbons comprising olefins and paraffins. More specifically, the invention concerns passing the feedstream to an amine treating zone for the removal of $H_2S$, a mercaptan treating zone for the removal of mercaptan sulfur compounds, and an adsorption zone for the removal of the trace polar compounds.

DISCUSSION OF RELATED ART

The fluid catalytic cracking (FCC) process is a process for the conversion of straight-run atmospheric gas oil, vacuum gas oils, certain atmospheric residues, and heavy stocks recovered from other operations into high-octane gasoline, light fuel oils, and olefin-rich light gases. In a petroleum refinery the FCC unit typically processes 30 to 50% of the crude oil charged to the refinery. Early FCC units were designed to operate on vacuum gas oils directly fractionated from crude oils. Typically, these vacuum gas oils came from highly quality crude oils. Today, much of the high quality feedstock for FCC units has been depleted and modern FCC units process less favorable materials. These less favorable materials include a substantial amount of sulfur containing materials and a growing portion of the non-distillable fraction of the crude oil. As a result, the contaminant level of the FCC product fractions have increased, particularly in the $C_3$–$C_5$ product fraction. Without appropriate treatment, the contaminants in the $C_3$–$C_5$ product fractions can be transmitted to sensitive downstream processes where they reduce the effectiveness of downstream catalysts and create unfavorable by-product reactions in processes such as alkylation and etherification.

Propylene and butylene and pentenes make up the majority of the olefin-rich light products produced in the catalytic cracking of crude oil. Propylene is also used as a feedstock in the manufacture of iso-propanol, acrylonitrile, propylene oxide, and polypropylene, and used with propane as a fuel. As such, the propylene must meet "chemical grade" or "polymer grade" purity specifications and meet a corrosive sulfur specification, respectively. Essentially all of the butylene and the major fraction of the propylene may be subsequently alkylated with iso-butane or etherified with methanol to produce motor gasoline. Pentenes, which are obtained by depentanizing of FCC gasoline are often present in the olefin feed to the alkylation unit and alkylated with isobutane. Pentenes may also be used in the production of TAME, tertiary amyl methyl ether, an oxygenate used in the production of oxygen containing gasoline and reformulated gasoline. Typically, the fresh olefin feed to an alkylation unit contains 40–70% $C_3$–$C_5$ olefins of which 40–80% is butylene while the balance is primarily propylene.

Etherification processes are currently in great demand for making high octane compounds which are used as blending components in lead-free gasoline. These etherification processes will usually produce ethers by combination of an isoolefin with a monohydroxy alcohol such as methanol or ethanol. The etherification process can also be used as a means to produce pure isoolefins by cracking of the product ether. For instance, pure isobutylene can be obtained for the manufacture of polyisobutylenes and tert-butyl-phenol by cracking methyl tertiary butyl ether (MTBE). The production of MTBE has emerged as a predominant etherification process which uses $C_4$ isoolefins as the feedstock. A detailed description of processes, including catalyst, processing conditions, and product recovery, for the production of MTBE from isobutylene and methanol are provided in U.S. Pat. Nos. 2,720,547 and 4,219,678 and in an article at page 35 of the Jun. 25, 1979 edition of Chemical and Engineering News. The preferred process is described in a paper presented at The American Institute of Chemical Engineers, 85th National Meeting on Jun. 4–8, 1978, by F. Obenaus et al. The above references are herein incorporated by reference. Other etherification processes of current interest are the production of tertiary amyl methyl ether (TAME) by reacting $C_5$ isoolefins with methanol, and the production of ethyl tertiary butyl ether (ETBE) by reacting $C_4$ isoolefins with ethanol.

Alkylation reactions are typically carried out in a liquid phase in the presence of a concentrated HF or $H_2SO_4$ acid catalyst in a reaction zone. From the reaction zone, the hydrocarbon products and the catalyst are separated, and the catalyst phase is returned to the reaction zone. The hydrocarbon products are fractionated to produce propane, recycle isobutane, normal butane and alkylate. In a typical HF alkylation unit with an external acid regenerator, a portion of the catalyst phase is withdrawn as a drag stream and charged to the acid regenerator. The acid regenerator separates acid soluble oils formed in the reaction zone, and an azeotrope of Hf acid and water from the drag stream. The regenerated HF acid is cooled and returned to the reactor. The presence of water in the feed results in a loss of acid by the formation of the HF acid/water azeotrope. The presence of other impurities such as sulfur lead to the formation of acid soluble oils.

Some HF alkylation units use an internal acid regeneration technique which eliminates the need for a separate acid regenerator. Internal acid regeneration can greatly reduce acid consumption, but the technique is sensitive to the amount of water and sulfur in the feed. Using an internal acid regenerator with high levels of feed contaminants, such as sulfur and water, can result in loss in octane of the alkylate and contamination of the alkylate product. Common HF alkylation processes and the operation of units with external acid regenerators described in the "*Handbook of Petroleum Refining Processes,*" edited by Robert A. Meyers, pp. 1–3 to 1–28, McGraw Hill Book Company, New York, 1986 and is herein incorporated by reference. The presence of contaminants such as sulfur compounds, water, and butadiene in the feed can lead to a high acid catalyst consumption rate, lower octane alkylate and excessive equipment corrosion. The sulfur compounds present are typically but not exclusively hydrogen sulfide and low molecular weight mercaptans which are present as such in the plant crude oil and/or produced by decomposition of higher molecular weight sulfur compounds during subsequent processing, e.g., catalystic cracking.

It is conventional to remove sulfur compound contaminants from olefin-containing process streams including alkylation feed and propylene by chemical methods such as scrubbing with an alkanolamine such as mono and diethanolamine to remove hydrogen sulfide and carbonyl sulfide followed by a caustic-water wash to remove mercaptans and finally by a dryer to remove water. Although zeolitic molecular sieve adsorbents have before been utilized to remove hydrogen sulfide and mercaptans from a wide variety of hydrocarbon process streams, it is known that olefins coadsorbed with these impurity materials cause the formation of undesirable coke deposits on the zeolite particles when the zeolite particles are heated to desorption temperatures and purged with natural gas to desorb the accumulated sulfur compounds. Collins et al. in U.S. Pat. No. 3,816,975 disclose such a process for the removal of water and sulfur compounds from a feed to an alkylation unit.

The separation of polar compounds from solutions thereof in hydrocarbons has been attempted by various means. Cohen et al. in U.S. Pat. No. 3,922,217 disclose a process for removing polar compounds such as sulfolane and methylpyrrolidone from a mixture of $C_6$–$C_8$ hydrocarbons by contacting the mixture with a gel-type cationic exchange resin containing 1 to 30% by weight water.

A Russian inventor's Certificate No. SU 222347 describes a process for the purification of $C_4$–$C_5$ hydrocarbons. The process teaching includes the purification of a $C_4$–$C_5$ hydrocarbon stream to remove acetonitrile by adsorption with an adsorbent consisting of sodium A zeolite and the subsequent regeneration of the adsorbent with inert gases or hydrocarbon vapors. A high purity acetonitrile stream is recovered from the regenerant stream. The only material to be recovered from the $C_4$–$C_5$ hydrocarbon stream is acetonitrile.

In U.S. Pat. No. 5,081,325, Haynal et al. disclose a method for removing polar bodies and other contaminants, including sulfur compounds, oxygenates, and color bodies, from unsaturated hydrocarbons having a boiling range between 280°–310° F. and containing more than 50% styrenics by contacting the unsaturated hydrocarbon stream with a neutral clay such as attapulgite clay. Haynal et al. further disclose that the method is most effective if the unsaturated hydrocarbon stream is first dried using a molecular sieve such as a 13X zeolite. Haynal et al. teach that certain molecular sieves, such as the 13X molecular sieve can remove polar bodies and other contaminants in the treatment of these unsaturated hydrocarbon streams in the 280°–310° F. boiling range, but Haynal et al. point out that the 13X molecular sieve is less effective and much more expensive than clay adsorbents.

In a number of refineries which operate the FCC at high severities on heavy, high-sulfur crudes, the above combination of amine treating and mercaptan sulfur removal in a mercaptan treating zone has not been sufficient to overcome a surprisingly high catalyst consumption in alkylation processes and the premature loss of catalyst life in etherification processes. Typically, the effluent from the mercaptan treating zone is passed to either an alkylation zone to produce high octane alkylate product or an etherification zone for the production of methyl tertiary butyl ether or ethyl tertiary butyl ether. Normally, removal of sulfur compounds to a level of less than 20 ppm-wt. sulfur is sufficient for the economic operation of both alkylation and etherification processes. Processes are sought to enhance the treatment of the $C_3$–$C_5$ product fraction from the FCC process to improve the operation of downstream alkylation and etherification processes.

BRIEF SUMMARY OF THE INVENTION

It is a broad object of this invention to provide an effective means for improving catalyst life, enhancing yields and improving the economic benefits of producing motor gasoline components from the $C_3$–$C_5$ product fraction of a fluid catalytic cracking unit. It was discovered that the $C_3$–$C_5$ product fraction from a fluid catalytic cracking (FCC) unit can contain trace amounts of polar compounds, specifically oxygenates and nitrogen compounds, and more specifically those oxygenates and nitrogen compounds comprising alcohols, ketones and nitriles having 1 to 3 carbon numbers, and most specifically, acetone or acetonitrile or propionitrile. In addition to the discovery of these contaminants, this invention provides a highly effective means for their removal. The invention may be employed in process arrangements that convert the $C_3$–$C_5$ product fraction from an FCC into alkylate or into ethers to produce high octane motor gasoline blending components for reformulated gasolines. This invention improves the operation of downstream alkylation and etherification processes toward the production of reformulated gasoline.

The invention provides a process for removing sulfur compounds, including $H_2S$, COS and mercaptan compounds, and a trace amount of acetonitrile or acetone or propionitrile from a hydrocarbon feedstream. The hydrocarbon feedstream is a $C_3$–$C_5$ product fraction from a fluid catalytic cracking unit (FCC). The process comprises the following steps. The hydrocarbon feedstream is contacted with an alkanolamine solution in an amine treating zone under $H_2S$ and COS absorption conditions to provide an $H_2S$- and COS-depleted stream. The $H_2S$- and COS-depleted stream is contacted with an alkaline scrubbing solution in a mercaptan absorption zone under mercaptan absorption conditions to provide a mercaptan-depleted stream. The mercaptan-depleted stream is contacted with the polar compound selective adsorbent in an adsorption zone comprising an adsorbent bed containing said adsorbent at adsorption conditions effective to adsorb the trace amount of acetonitrile or acetone or propionitrile, and to produce a treated product essentially free of polar compounds. The treated product is recovered.

In one embodiment, the invention is an alkylation process for the removal of compounds, including $H_2S$, COS, and mercaptan compounds, and a trace amount of polar compounds comprising acetonitrile or acetone or propionitrile from a hydrocarbon feedstream. The hydrocarbon feedstream is a $C_3$–$C_5$ product fraction from a fluid catalytic cracking unit. The process comprises the following steps. The hydrocarbon feedstream is contacted with an alkanolamine solution in an amine treating zone under $H_2S$ and COS absorption conditions to provide an $H_2S$- and COS-depleted stream. The $H_2S$- and COS-depleted stream is contacted with an alkaline scrubbing solution in a mercaptan absorption zone under mercaptan sulfur absorption conditions to produce a mercaptan-depleted stream. The mercaptan-depleted stream is contacted with a polar compound selective adsorbent in an adsorption zone comprising an adsorbent bed containing said adsorbent. The adsorbent bed is maintained at adsorption conditions effective to adsorb the trace amount of polar compounds to produce a polar-compound-depleted stream. The polar-compound-depleted stream and an isoparaffin stream are passed into an alkylation zone to produce an alkylate product. At least a portion of the isoparaffin stream is heated to provide a regenerant vapor stream. The polar compound selective adsorbent in the adsorption zone is regenerated by contacting the polar compound selective adsorbent with the regenerant vapor stream at regeneration conditions to desorb the polar compounds and to provide a spent regenerant vapor stream. The spent regenerant vapor stream is condensed and a hydrocarbon phase and an aqueous phase are recovered. At least a portion of the hydrocarbon phase is recycled to provide a portion of the regenerant vapor stream. The aqueous phase comprising the polar compounds is removed.

In another embodiment, the invention is an etherification process for the removal of sulfur compounds including $H_2S$, COS and mercaptan sulfur compounds, and a trace amount of polar compounds comprising acetonitrile or acetone or propionitrile from a hydrocarbon feedstream. The hydrocarbon feedstream comprises a $C_3$–$C_5$ product fraction from a fluid catalytic cracking unit. The process comprises the following steps. The hydrocarbon feedstream is contacted with an alkanolamine solution in an amine treating zone under $H_2S$ and COS absorption conditions to provide an $H_2S$- and COS-depleted stream. The $H_2S$- and COS-depleted stream is contacted with an alkaline scrubbing solution in a mercaptan absorption zone under mercaptan sulfur absorption conditions to produce a mercaptan-depleted stream. The mercaptan-depleted stream is contacted with a polar compound selective adsorbent in an adsorption zone comprising an adsorbent bed containing the polar compound selective adsorbent at adsorption conditions effective to adsorb the trace amount of polar compounds to produce a polar-compound-reduced stream. The polar-compound-reduced stream and an alcohol stream is passed to an etherification zone to produce an ether product. A regenerant stream selected from the group consisting of fuel gas, natural gas, nitrogen or hydrogen is heated to provide a heated regenerant vapor stream. The polar compound selective adsorbent in the adsorption zone is regenerated by contacting the polar compound selective adsorbent with the heated regenerant vapor stream at regeneration conditions to desorb the polar compounds and to provide a spent regenerant vapor stream. The spent regenerant vapor stream is condensed and a hydrocarbon phase and an aqueous phase is recovered. The hydrocarbon phase is recycled to provide a portion of the regenerant vapor stream. The aqueous phase comprising the polar compounds is removed.

Additional embodiments, aspects and details of this invention are set forth in the following detailed description.

DETAILED DESCRIPTION OF THE INVENTION

Figure 1:
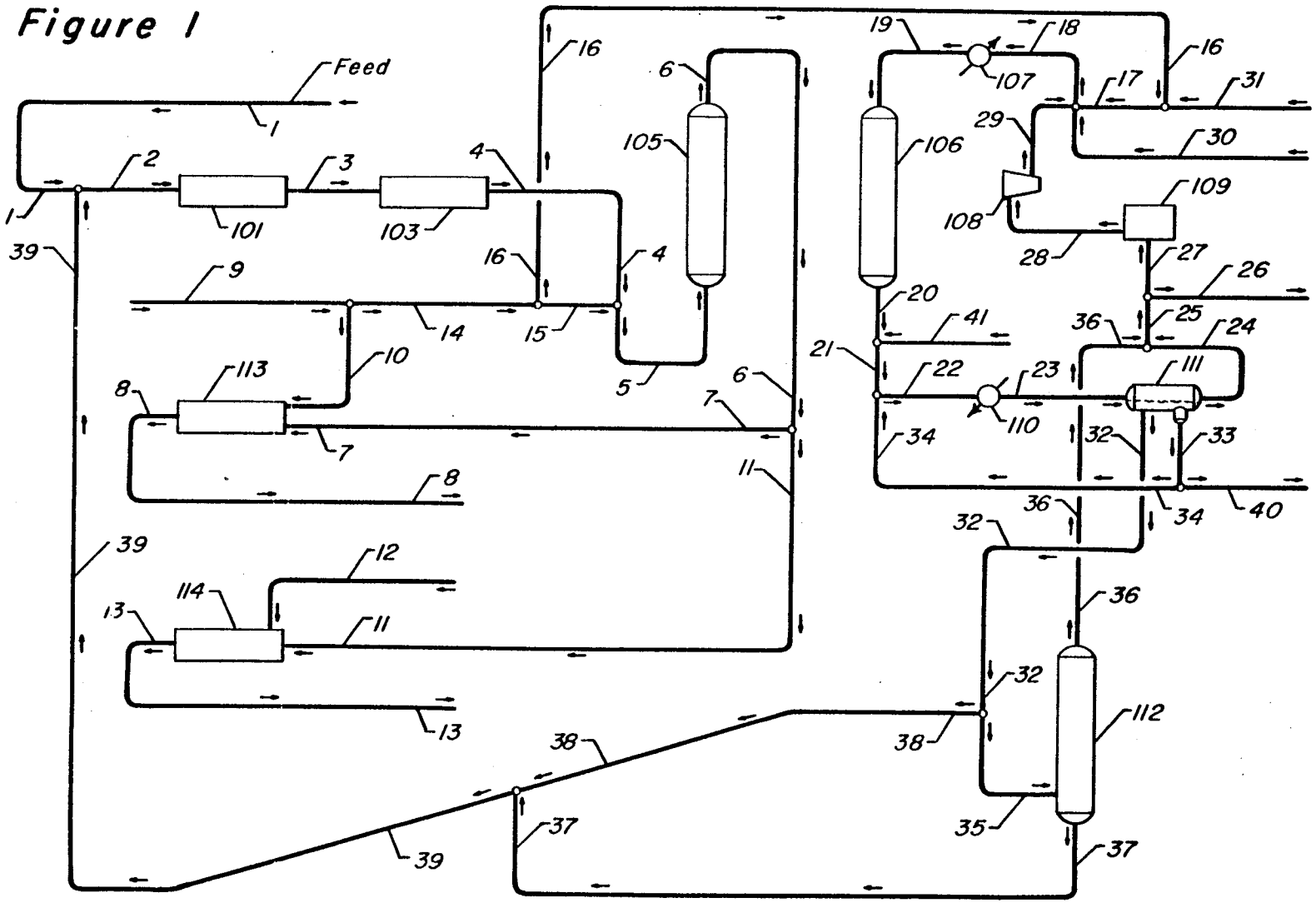
FIG. 1 is a schematic illustration of the process for the removal of sulfur compounds and trace amounts of acetonitrile and acetone.

The hydrocarbon feedstream being treated in accordance with this invention is derived from a fluid catalytic cracking (FCC) unit and typically is composed of any proportion of monoolefin and paraffin, each containing from 3 to 5 carbon atoms, but preferably is comprised of a major proportion of paraffin with respect to the monoolefin constituent. The paraffins include isobutane, isopentane, normal pentane, as well as propane and n-butane. The monoolefins include butene-1, butene-2, isobutene, 2-methyl-2-butene, 2-methyl-1-butene, 3-methyl-1-butene, 1-pentene, 2-pentene, cyclopentene and propylene. The hydrocarbon feedstream may also contain diolefins such as 1,3-butadiene and 1,3-pentadiene. Minor proportions of both paraffinic and olefinic molecules of various numbers of carbon atoms which can result from distillation procedures to obtain the $C_3$–$C_5$ hydrocarbons are not harmful to the process and can be present. The hydrocarbon feedstream typically contains 30 to 60 mol % olefins.

The sulfur compound impurities present in the hydrocarbon feedstream can constitute a total of from 1 to 5,000 ppm (wt.) calculated as elemental sulfur of the feedstock. Examples include hydrogen sulfide, mercaptans, carbonyl sulfide, and carbon disulfide. In the case of hydrocarbon feedstreams, such as isoparaffin alkylation feedstreams, which have been formed from various distillation fractions, little or no $H_2S$ will be present and the principal sulfur compound impurities will be the alkyl mercaptans whose boiling points approximate the paraffin constituents of the feedstock. It will be understood that certain of the sulfur compound molecules in the hydrocarbon feedstream can undergo chemical reactions or transformations in contact with the zeolite in the adsorption bed. Accordingly, even if $H_2S$ is not a constituent of the hydrocarbon feedstream, if can be produced in the bed by decomposition of a mercaptan.

Water and its precursors may also be present in the hydrocarbon feedstream in amounts from 5 wt. ppm to saturation which typically is about 500 wt. ppm, measured as $H_2O$. The contaminants may also be oxygenated hydrocarbon compounds, otherwise known as oxygenates, such as alcohols, ethers, aldehydes, ketones, and acids. Specific examples of these oxygenates are ethanol, methanol, isopropanol, tertiary butyl alcohol, dimethyl ether, methyl tertiary butyl ether, acetone, and acetic acid. Acetone may be present in trace amounts ranging from about 1 to about 500 wt. ppm. Nitrogen compounds, particularly acetonitrile, may be present in trace amounts ranging from about 1 to about 1000 wt. ppm and more typically from about 15 to about 80 wt. ppm. Other polar compounds such as propionitrile also may be present. The feedstream may or may not have been subject to a selective hydrogenation process for the saturation of diolefins prior to its use in the pretreating process of the instant invention. Typically, the feedstream from the FCC may contain from about 1000 ppm-wt. to about 2 vol. % butadiene or diolefin. The effluent from a selective hydrogenation process will typically contain less than 50 ppm-wt. diolefins.

In accordance with the invention, the hydrocarbon feedstream comprising a $C_3$–$C_5$ product fraction from the FCC unit is processed in an amine treating zone employing alkanolamines selected from the group consisting of monoethanolamine (MEA), diethanolamine (DEA), methyldiethanolamine (MDEA), and mixtures thereof, for primary removal of $H_2S$ and partial removal of COS. Generally, the present invention is applicable to hydrocarbon feedstreams containing from about 1 wt. ppm to about 5000 wt. ppm $H_2S$ and COS, more typically from about 1 to about 1000 wt. ppm $H_2S$ and COS. The feedstream may also contain varying amounts of water and small amounts of ethylene. The amine treating zone is operated under $H_2S$ and COS absorption conditions over a temperature ranging from about 60 ° to about 150° F. and a pressure ranging from about 15 to about 500 psia. The amine treating zone will provide an $H_2S$- and COS-depleted stream which has been reduced by about 90% and preferably reduced by about 95% of the $H_2S$ and COS originally present in the hydrocarbon feedstream.

In one aspect of the invention, a separate amine treating unit may be employed to remove $H_2S$ and COS from the spent regeneration gas thus removing $H_2S$ and COS from the process and permitting at least a portion of the regeneration gas to be reused in the desorption of water, sulfur compounds, propionitrile, acetonitrile and acetone from the polar compound selective adsorbent.

The $H_2S$- and COS-depleted stream is passed to a mercaptan treating zone wherein the $H_2S$- and COS-depleted stream is contacted with an alkaline scrubbing solution under mercaptan absorption conditions effective to produce a mercaptan-depleted stream and a mercaptide-containing scrubbing solution. The mercaptan sulfur absorption conditions include a temperature ranging from about 15° C. (60° F.) to about 66° C. (150° F.), and a pressure ranging from about 100 kPa (15 psia) to about 3450 kPa (500 psia). The alkaline scrubbing solution may be selected from the group consisting of aqueous sodium hydroxide or aqueous ammonium hydroxide. The mercaptide-containing scrubbing solution is contacted with air or oxygen in the presence of an oxidation catalyst effective to regenerate the mercaptide-containing scrubbing solution. The temperature of the scrubbing solution ranges between about 10° and about 80° C., preferably between about 20° and about 60° C. and a pressure generally in the range of about 100 kPa absolute to about 3450 kPa absolute in order to keep the $H_2S$- and COS-depleted stream in the liquid phase.

The oxidation catalyst which is employed is a metal chelate dispersed on an adsorbent support. The adsorbent support which may be used in the practice of this invention can be any of the well known adsorbent materials generally utilized as a catalyst support or carrier material. Preferred adsorbent materials include the various charcoals produced by the destructive distillation of wood, peat, lignite, nutshells, bones and other carbonaceous matter, and preferably such charcoals as have been heat treated or chemically treated or both, to form a highly porous particle structure of increased adsorbent capacity, and generally defined as activated carbon or charcoal. The adsorbent materials must also include the naturally occurring clays and silicates, that is, diatomaceous earth, fuller's earth, kieselguhr, attapulgus clay, feldspar, montmorillonite, halloysite, kaolin, and the like, and also the naturally occurring or synthetically prepared refractory inorganic oxides such as alumina, silica, zirconia, thoria, boria, etc., or combinations thereof like silica-alumina, silica-zirconia, alumina-zirconia, etc. Any particular solid adsorbent material is selected with regard to its stability under conditions of its intended use. For example, in the treatment of a solid petroleum distillate, the adsorbent support should be insoluble in, and otherwise inert to, the hydrocarbon fraction at the alkaline reaction conditions existing in the mercaptan treating zone. Charcoal, and particularly activated charcoal, is preferred because of its capacity for metal chelates, and because of its stability under mercaptan treating conditions.

Another necessary component of the oxidation catalyst used in this invention is the metal chelate which is dispersed on an adsorptive support. The metal chelate employed in the practice of this invention can be any of the various metal chelates known to the art as effective in catalyzing the oxidation of mercaptans contained in a sour petroleum distillate, to disulfides or polysulfides. The metal chelates include the metal compounds of tetrapyridinoporphyrazine described in U.S. Pat. No. 3,980,582, e.g., cobalt tetrapyridinoporphyrazine; porphyrin and metaloporphyrin catalysts as described in U.S. Pat. No. 2,966,453, e.g., cobalt tetraphenylporphyrin sulfonate; corrinoid catalysts such as described in U.S. Pat. No. 3,252,892, that is, cobalt corrin sulfonate; chelate organometallic catalysts such as described in U.S. Pat. No. 2,918,426, e.g., the condensation product of an aminophenol and a metal of group VIII; the metal phthalocyanines as described in U.S. Pat. No. 4,290,913, etc. As stated in U.S. Pat. No. 4,290,913, metal phthalocyanines are a preferred class of metal chelates. Cobalt phthalocyanine is the preferred metal phthalocyanine. All of the above cited U.S. patents are incorporated by reference.

An optional component of the catalyst is an onium compound. An onium compound is an ionic compound in which the positively charged (cationic) atom is a non-metallic element other than carbon and which is not bonded to hydrogen. The onium compounds which can be used in this invention are selected from the group consisting of quaternary ammonium, phosphonium, arsonium, stibonium, oxonium and sulfonium compounds, that is, the cationic atom is nitrogen, phosphorus, arsenic, antimony, oxygen and sulfur, respectively. The use of onium compounds is described in U.S. Pat. No. 4,897,180 which is incorporated by reference.

The mercaptan-depleted stream withdrawn from the mercaptan treating zone is depleted in mercaptan compounds, $H_2S$ and COS. Typically, the mercaptan-depleted stream is saturated with water as it leaves the mercaptan treating zone. The mercaptan-depleted stream is passed to an adsorption zone containing a polar compound selective adsorbent. The polar compound selective adsorbent is a zeolitic molecular sieve adsorbent. As used here, the term "molecular sieve" is defined as a class of adsorptive desiccants which are highly crystalline in nature, distinct from amorphous materials such as gamma-alumina. Preferred types of molecular sieves within this class of crystalline absorbents are aluminosilicate materials commonly known as zeolites. The term "zeolite" in general refers to a group of naturally occurring and synthetic hydrated metal aluminosilicates, many of which are crystalline in structure. There are, however, significant differences between the various synthetic and natural materials in chemical composition, crystal structure and physical properties such as X-ray powder diffraction patterns. The zeolites occur as agglomerates of fine crystals or are synthesized as fine powders and are preferably tableted or pelletized for large-scale adsorption uses. Pelletizing methods are known which are very satisfactory because the sorptive character of the zeolite, both with regard to selectivity and capacity, remains essentially unchanged.

The pore size of the zeolitic molecular sieves may be varied by employing different metal cations. For example, sodium zeolite A has an apparent pore size of about 4 Å units, whereas calcium zeolite A has an apparent pore size of about 5 Å units. The term apparent pore size as used herein may be defined as the maximum critical dimension of the molecular sieve in question under normal conditions. The apparent pore size will always be larger than the effective pore diameter, which may be defined as the free diameter of the appropriate silicate ring in the zeolite structure.

Among the naturally occurring zeolitic molecular sieves suitable for use in the present invention is faujasite having a pore size of about 10 Å. The natural materials are adequately described in the chemical literature. The preferred synthetic crystalline zeolitic molecular sieves include zeolites X, Y and L. Zeolite L has an apparent pore size of about 10 Å, and is described and claimed in U.S. Pat. No. 3,216,789. Zeolite X has an apparent pore size of about 10 Å, and is described and claimed in U.S. Pat. No. 2,882,244, having issued Apr. 14, 1959 to R. M. Milton. Zeolite Y has apparent pore size of about 10 Å, and is described and claimed in U.S. Pat. No. 3,130,007.

Type 13X sieves are most preferred in the adsorption zone. The general chemical formula for a molecular sieve composition known commercially as type 13X is:

$$1.0\pm0.2Na_2O:1.00Al_2O_3:2.5\pm0.5SiO_2$$

plus water of hydration. Type 13X has a cubic crystal structure which is characterized by a three-dimensional network with mutually connected intracrystalline voids accessible through pore openings which will admit molecules with critical dimensions up to 10 Å. The void volume is 51 vol. % of the zeolite and most adsorption takes place in the crystalline voids.

The 13X sieve will permit the adsorption of water, hydrocarbons and other molecules present such as the remaining portion of the $H_2S$ and COS unadsorbed in the amine treating zone, mercaptan compounds, and any disulfides produced in the mercaptan treating zone. Most importantly, the 13X sieve will permit the adsorption of trace amounts of polar compounds, particularly a trace amount of acetonitrile and acetone, and produce a treated product essentially free of acetonitrile, acetone and propionitrile, and containing less than 5 wt. ppm acetonitrile and acetone.

The adsorption zone consists of at least two or more adsorbent beds containing the polar compound selective adsorbent. The adsorption conditions for the operation of the adsorption zone consist of an adsorption temperature ranging from about 60° to about 150° F. (15°-66° C.) and an adsorption pressure ranging from about 15 to about 500 psia (100-3450 kPa). Typically, at least one bed to be operated in the adsorption mode while the remaining adsorbent bed, or beds, is being regenerated. In the adsorption mode, the stream to be treated is typically introduced at the bottom of the adsorbent bed, and during the regeneration mode, during the heating step regenerant is introduced at the top of the adsorbent bed. The regenerant, usually introduced as a vapor stream, is selected from the group consisting of propane, normal butane, isobutane, pentanes, a $C_5$ paraffin isomerate, a $C_6$ paraffin isomerate, fuel gas, natural gas, nitrogen, hydrogen and mixtures thereof. Of these possible regenerants, fuel gas, natural gas, nitrogen and hydrogen are considered non-condensible regenerants and the remainder are condsidered condensible, depending upon the operating conditions of the regeneration steps.

The regeneration of the adsorbent bed comprises passing a heated regenerant stream over the adsorbent bed to desorb the contaminants; cooling the adsorbent bed with a cooled regenerant stream; and displacing the cooled regenerant in the adsorbent bed with either the treated product or the feed prior to the resumption of the adsorption step. The regenerant may be a condensable vapor or a non-condensable vapor. The feed and the treated product contain a significant amount of olefins and diolefins which could form coke if introduced to a hot adsorbent bed. Furthermore, coking reactions may occur on reintroducing the feed or treated product as a result of the heat of adsorption generated from contacting the olefins and diolefins with the adsorbent. To minimize the potential for coke formation on the adsorbent during the cooling step, two separate strategies may be employed depending upon the nature of the regenerant. If the regenerant is a non-condensable gas, a preload and filling step may be carried out during the latter part of the cooling step.

The second strategy uses the latent heat of vaporization of the regenerant to offset the heat of adsorption. If the regenerant stream is a condensable vapor such as propane, butane, or heavier, the cooling and filling is carried out with a cool regenerant stream. During the cooling and filling steps of the regeneration, the regenerant is introduced at the bottom of the adsorbent bed. After the adsorbent bed is filled with regenerant liquid, the regenerant flow is stopped and the regenerant in the adsorbent bed is displaced with feed, introduced at the feed end of the adsorbent bed. Since the adsorbent bed is preloaded with saturated hydrocarbons from the regenerant stream, there is not a great release of heat when the olefinic feed to the adsorption zone contacts the cooled adsorbent in the adsorbent bed.

The regeneration of the adsorbent bed comprises heating a regenerant stream to provide a heated regenerant vapor at regeneration conditions including a temperature ranging from about 300° to about 550° F. (149°-288° C.) and a pressure ranging from about 15 to about 500 psia (100-3450 kPa). The regenerant vapor is introduced to the effluent end of the adsorbent bed undergoing regeneration, and a spent regenerant stream comprising desorbed acetonitrile, propionitrile, acetone, water, other oxygenates, and sulfur compounds is withdrawn from the feed end of the adsorbent bed. The introduction of the regenerant vapor stream is continued for a period of from about 4 to about 24 hours, preferably 8 to 20 hours, at regeneration conditions to remove previously adsorbed compounds.

At the completion of the heating step, the flow of heated regenerant is terminated and the adsorbent bed is cooled by passing an unheated or cooled regenerant stream to the bottom of the adsorbent bed. If the regenerant is condensible and liquid, as the first amount of liquid regenerant reaches the heated adsorber bed, a portion of the liquid regenerant vaporizes and provides some sensible cooling of the adsorber bed. As the cooling process continues, the liquid regenerant and any vapor portion is passed through the adsorber bed to a condenser where it is initially condensed. Later in the cooling process, the liquid regenerant having passed through the adsorber travels to the condenser, yet the condenser simply functions to produce a constant temperature for the collection of the cooled regenerant. The condensed regenerant during the heating process and the liquid regenerant collected during the cooling step is treated for the removal of sulfur compounds and desorbed acetonitrile or acetone or propionitrile is either removed from the process, or recirculated to the amine treating zone. At the conclusion of the cooling step, the flow liquid regenerant is terminated and the adsorbent bed is filled with the mercaptan-depleted stream.

As a practical matter, in order to provide for continuous operation of the adsorption zone, at least two adsorbent beds are used, at least one of such beds is operated for adsorption and at least one of the other of the adsorbent beds is operated for desorption. These adsorbent beds are switched or cycled in service at intervals that would preclude breakthrough of the trace amounts of acetonitrile or acetone or propionitrile, and provide a continuous operation.

Regeneration of the adsorbent bed cannot always return the adsorbent to the original removal efficiency or activity in a cyclic operation. Without being bound by any particular theory, it is applicant's contention that coking of the adsorbent occurs during regeneration, and this coking is the cause of the activity loss of the adsorbent. The reactions which create the coke occur at the regeneration temperatures particularly in the presence of unsaturated hydrocarbons such as olefins, diolefins, (e.g., butadiene) and acetonitrile. Applicant believes that if some hydrogen is added to the regeneration gas that these coking reactions will be minimized and the cyclic adsorption efficiency of the adsorbents will be maintained.

A further advantage for using hydrogen in the regeneration gas is that it allows for an improved combination of the mercaptan removal zone with the adsorption zone. Pilot plant data showed that disulfides were eluted along with mercaptans during regeneration. Because the disposal of these disulfides and mercaptans in the regeneration stream is not desirable, the addition of hydrogen during the regeneration will decompose the disulfides to $H_2S$ and the corresponding alkane. The $H_2S$ produced can then be removed by recycling the $H_2S$ to an amine treating zone.

A still further advantage results in that the saturation reactions which prevent the coking of the adsorbent in the presence of hydrogen, such as the decomposition of disulfides, are exothermic. Therefore, controlling the amount of hydrogen can limit the temperature rise across the adsorbent during regeneration and simultaneously reduce the energy required to preheat the regeneration gas. It is preferred that the hydrogen used in the regeneration step be essentially sulfur free and that the level of hydrogen in the regeneration gas be at least 100 ppm-vol. Hydrogen from a PSA unit, and catalytic reformer hydrogen which has been treated for chloride removal are preferred sources. Hydrogen may be circulated at any purity; however, a high purity, low molecular weight hydrogen stream has a heat capacity which can result in costly process heat exchanges and compressors. Therefore, the upper limit to hydrogen purity derived from economic considerations is about 70 vol. % with the remainder being methane. During the regeneration step, the spent regenerant stream is condensed to provide a hydrocarbon and an aqueous phase. If the regenerant contains noncondensibles such as hydrogen and light gases, a third phase will also be formed. Any non-condensibles may be treated to remove $H_2S$ in an $H_2S$ removal zone, compressed to adsorption pressure, and admixed with the regenerant stream. Typically, desorbed acetonitrile or acetone or propionitrile will be distributed between the aqueous phase and the hydrocarbon phase, with the majority of the acetonitrile and acetone in the aqueous phase. As an option, a portion of the aqueous phase may be admixed with the spent regenerant stream at a point before the spent regenerant stream is condensed and, additionally, a fresh water stream may be injected at the same point before the spent regenerant stream is condensed to enhance the recovery of the acetonitrile and acetone in the aqueous phase.

The hydrocarbon phase may be returned to the amine treating zone for removal of absorbed $H_2S$. If the regenerant stream contains more light hydrocarbons, such as methane and ethane, than can be accommodated by the downstream alkylation or etherification units, the hydrocarbon phase may be sent to a small stripper for the removal of these excess light hydrocarbons before returning the remaining portion of the hydrocarbon phase to the amine treating zone.

DETAILED DESCRIPTION OF THE DRAWING

In FIG. 1 the hydrocarbon feedstream comprising a $C_3$–$C_5$ product fraction from an FCC which contains sulfur compounds, including $H_2S$, COS and mercaptan sulfur, and trace amounts of polar compounds, enters via line 1 and is passed by line 2 to the amine treating zone 101. In the amine treating zone, the hydrocarbon feedstream is contacted with an alkanol amine solution to remove $H_2S$ and COS by selective absorption and provide an essentially $H_2S$ free amine treating effluent which is depleted in $H_2S$ and COS. The $H_2S$- and COS-depleted stream is passed by line 3 to a mercaptan treating zone 103. In the mercaptan treating zone, the $H_2S$- and COS-depleted stream is contacted with an alkaline scrubbing solution under mercaptan absorption conditions effective to produce a mercaptan-depleted stream and a mercaptide containing scrubbing solution. The mercaptan-depleted stream is passed by lines 4 and 5 to a first adsorbent bed 105 in an adsorption zone. Adsorbent bed 105 contains a polar compound selective adsorbent for the adsorption of trace amounts of oxygenates and nitrogen compounds, particularly acetone, acetonitrile, and propionitrile. The mercaptan-depleted stream is passed to the feed end of adsorbent bed 105 and a treated product essentially free of polar compounds is withdrawn from adsorbent bed 105 by line 6 from the effluent end of the adsorbent bed.

In an embodiment of the manufacture of high octane alkylate which includes the operation of alkylation zone 113, the treated product in line 6 is passed to line 7 where it is introduced to the alkylation zone. Typically, feed to an akylation zone must be dried to a level of less than 10 ppm-wt. water. The use of the polar compound selective adsorbent also removes water to the desired level and eliminates the need for further drying of the alkylation feeds. An isoalkane stream comprising isobutane is introduced via lines 9 and 10 to the alkylation zone to provide the necessary isoalkane to convert the $C_3$–$C_5$ olefins in line 7 to produce the alkylate product. The alkylate produced in the alkylation zone 113 is withdrawn via line 8. Typically, this stream is blended into high quality motor gasoline. If the isoalkane stream contains a significant amount of water, it may be dried in a separate drier using an appropriate adsorbent, or a portion of this stream may be admixed with the feed to adsorbent bed 105 by passing that portion of the isoalkane stream via lines 14 and 15 to a point where it is admixed with the hydrocarbon feedstream and passed via line 5 to the feed end of adsorbent bed 105. It is possible to send all of the isoalkane required in the alkylation zone through the adsorbent bed and in this way take advantage of the additional property of the polar compound selective adsorbent to dry the isoalkane stream before it reaches the alkylation zone. If the isoalkane stream also contained trace amounts of polar compounds, these contaminants would be adsorbed by the polar compound selective adsorbent.

In another embodiment relating to the manufacture of ethers, the treated product in line 6 would be passed by line 11 to an etherification zone 114. In this etherification zone 114, an alcohol such as methanol or ethanol in line 12 would be admixed with the treated product and passed over an acidic resin based catalyst at etherification conditions including a temperature at reactor inlet ranging from about 40° to about 60° C., and a pressure ranging from about 150 to about 300 psia for the production of an ether such as methyl tertiary butyl ether or ethyl tertiary butyl ether. The ether product would be withdrawn via line 13. If the treated product in line 6 comprised isopentene, the ether product produced would be tertiary amyl methyl ether.

Periodically, the absorbent beds containing the polar compound selective adsorbent in the adsorption zone are regenerated. The regeneration consists of the passing of a heated regenerant vapor over the adsorbent bed, typically introduced at the effluent end of the adsorbent bed and passed through to the feed end of the adsorbent bed. In this way, the adsorbed polar compounds, and any sulfur and water absorbed on the adsorbent may be desorbed. Streams suitable for use as a regenerant in this process can be selected from the group consisting of propane, normal butane, isobutene, isopentane, $C_5$ paraffin isomerate, fuel gas, natural gas, and hydrogen. The fuel gas streams should be substantially low in sulfur and diolefin and olefin content. The hydrogen streams should be substantially low in sulfur and may contain as little as 50% hydrogen on a molar basis. By way of illustration, a portion of the isoalkane stream in line 14 may be passed via line 16, 17 and 18 to heater 107. Heater 107 raises the temperature of the regenerant introduced via line 31 stream in line 18 to a regeneration temperature from about 300° to about 550° F. and a pressure of about 15 to about 500 psia to produce a heated regenerant vapor stream 19. The heated regenerant vapor stream is passed via line 19 to the effluent end of adsorbent bed 106 wherein it desorbs the adsorbed acetonitrile, acetone, water, other oxygenates, and sulfur compounds. At regeneration conditions, some activity by the polar compound selective adsorbent may result in coke formation on the adsorbent. These coking reactions occur at the regeneration temperature in the presence of unsaturated hydrocarbons such as olefins, diolefins and acetonitrile. In order to improve the regeneration step and minimize coking reactions, a small amount of hydrogen is introduced via line 30 to result in a hydrogen concentration in excess of 100 ppm in line 18 and passed to heat exchanger 107. The presence of the hydrogen reduces the formation of coke on the polar compound selective adsorbent and assists in the conversion of any disulfides, which may have carried over from the mercaptan treating zone, by converting the disulfides to $H_2S$ and the corresponding alkane at these elevated temperatures. Disposal of these disulfides and mercaptans in the spent regenerant stream is not desirable; but, by converting the disulfides and mercaptans to $H_2S$ and diverting the condensible and non-condensible hydrocarbon phases to the amine treating zone, the sulfur as $H_2S$ is removed from the system. The desorbed contaminants are removed from the system with the spent regenerant vapor stream which is passed via lines 20, 21 and 22 to condenser 110. Condenser 110 cools the spent regenerant vapor to a temperature from about 80° to about 120° F. to produce a hydrocarbon phase and an aqueous phase. The condensed phases are passed to flash drum 111 via line 23. In flash drum 111, three phases may be present. A hydrocarbon vapor phase comprising non-condensibles such as hydrogen, hydrogen sulfide, and light hydrocarbon gases is passed via lines 24, 25 and 26 to a fuel gas system. Alternatively, this hydrocarbon vapor phase stream in line 25 may be passed via line 27 to an $H_2S$ removal zone 109 which comprises a caustic wash or a second amine treating zone to remove $H_2S$. The $H_2S$-depleted gas withdrawn from the $H_2S$ removal zone is passed via line 28 to compressor 108 wherein it is raised to a pressure of between about 15 and about 500 psia, admixed via line 29 with regenerant stream 17 and recycled to the adsorbent bed 106 in regeneration.

The hydrocarbon liquid phase formed in condenser 111 is withdrawn via line 32 and typically passed via lines 38 and 39 to be admixed with the feedstream in line 1. Although this recycle stream may contain small amounts of $H_2S$, the impurity will be removed in the amine treater zone 101. Any residual acetonitrile or acetone or propionitrile in the recycle stream 39 will be removed in the adsorption zone 105. Returning to flash drum 111, the aqueous phase is removed via line 33. This aqueous phase will contain a majority of the nitrogen compounds such as acetonitrile and propionitrile and oxygenates such as acetone. This aqueous phase is typically sent to a safe disposal system via line 40 such as a refinery sour water stripping operation, or a portion of this stream may be recycled via line 34 and admixed with the spent regenerant vapor stream 21 at a point before the spent regenerant vapor stream enters the condenser to enhance the removal of the water soluble species (i.e., oxygenates and nitrogen compounds) from the hydrocarbon phase. In addition, fresh water may be injected at the point before the spent vapor stream enters the condenser via stream 41 to further enhance the removal of the water soluble species from the hydrocarbon phase.

If fuel gas, or a hydrogen stream, is used as the regenerant stream, and these streams contain a significant amount of light hydrocarbons which might affect downstream fractionation operations such as in alkylation units, a portion of the hydrocarbon phase may be withdrawn from the flash drum 111 via line 32 and passed via line 35 to a stripper 112. A non-condensible stream comprising the light hydrocarbons is withdrawn from the top of the stripper via line 36 and admixed with a vapor from the top of the flash drum in line 24. Heavier hydrocarbons which may also contain some mercaptans, $H_2S$ and acetonitrile are withdrawn via line 37 and line 39. Line 39 is admixed with the hydrocarbon feedstream to the complex upstream of the amine treater zone 101.

It is to be understood that in the present invention, it is not necessary to have the mercaptan-depleted stream leaving the mercaptan absorption zone immediately subjected to the adsorption zone for the removal of trace amounts of acetonitrile or acetone or propionitrile. Indeed, there may be one or more process steps that are carried out on the mercaptan-depleted stream in whole or in part prior to its being introduced to the adsorption zone for the removal of trace amounts of acetonitrile or acetone or propionitrile.

The invention will be more fully understood by reference to the following examples, and comparative data which demonstrate the high selectivity for polar compounds of the adsorbent of this invention.

EXAMPLE 1

A series of field tests were made on a $C_4$–$C_5$ fraction comprising olefins and paraffins from a commercial FCC unit. The $C_4$–$C_5$ stream had been pretreated in an amine treating zone and a mercaptan absorption zone and contained the following trace contaminants:

| Contaminants: | Typical | Minimum | Maximum |
|---|---|---|---|
| Mercaptans, wt. ppm | 3 | 1 | 8 |
| Disulfides, wt. ppm | 2 | 1 | 6 |
| Acetonitrile, wt. ppm | 35 | 15 | 80 |
| Acetone, wt. ppm | 70 | trace | 110 |

It was expected to find small amounts of mercaptans and disulfides in the $C_4$–$C_5$ stream, but it was surprising and unexpected to discover the presence of acetonitrile and acetone in concentrations ranging from TRACE to 110 wt. ppm. These contaminants in the feed to the downstream HF alkylation unit resulted in the formation of high levels of acid soluble oils from the unwanted side reactions. The downstream HF alkylation unit utilized an HF acid regenerator to remove acid soluble oils and an HF acid/water azeotrope from the circulating HF acid. The HF alkylation was operating at 40,000 BPSD of high octane alkylate and was limited by the capacity of the HF acid regenerator. Furthermore, the high levels of the acid soluble oils contributed to higher acid consumption and lower acid purity in the HF alkylation unit.

EXAMPLE 2

A pilot plant was placed in operation on a slip stream of the $C_4$–$C_5$ stream of Example 1 for the evaluation of adsorbents. A slip stream of the isobutane feed to the HF alkylation unit was employed as the regenerant stream. The isobutane feed contained 86% isobutane, 3% propane and the balance normal butane. No detectable amount of sulfur, nitrogen compounds or oxygen compounds was present in the isobutane feed. The pilot plant consisted of two adsorbent chambers enclosed in a portable cabinet which was nitrogen purged. The two chambers were operated in a cyclic adsorption and regeneration sequence, processing approximately 1 gallon per hour of $C_4$–$C_5$ feed and a fractional amount of regenerant isobutane flow. The following average operating conditions were employed in the tests:

| | |
|---|---|
| Adsorption Temperature | 100° F. |
| Adsorption Pressure | 165 psia |
| Regeneration Temperature | 425° F. |
| Regeneration Pressure | 90 psia |

Using a 13X zeolite adsorbent and a 4 hour adsorption cycle, the combined water, acetone, acetonitrile and sulfur level of the treated product was reduced to less than 5 wt. ppm. At this low level of contaminants, an engineering design calculation determined that the throughput of the entire HF alkylation unit could be increased from about 10 to about 20 percent producing the same octane quality. At the 40,000 BPSD throughput, the HF acid consumption in the HF alkylation unit could be reduced by about 15 to about 25 percent by the removal of the acetonitrile and acetone contaminants.

EXAMPLE 3

Figure 2:
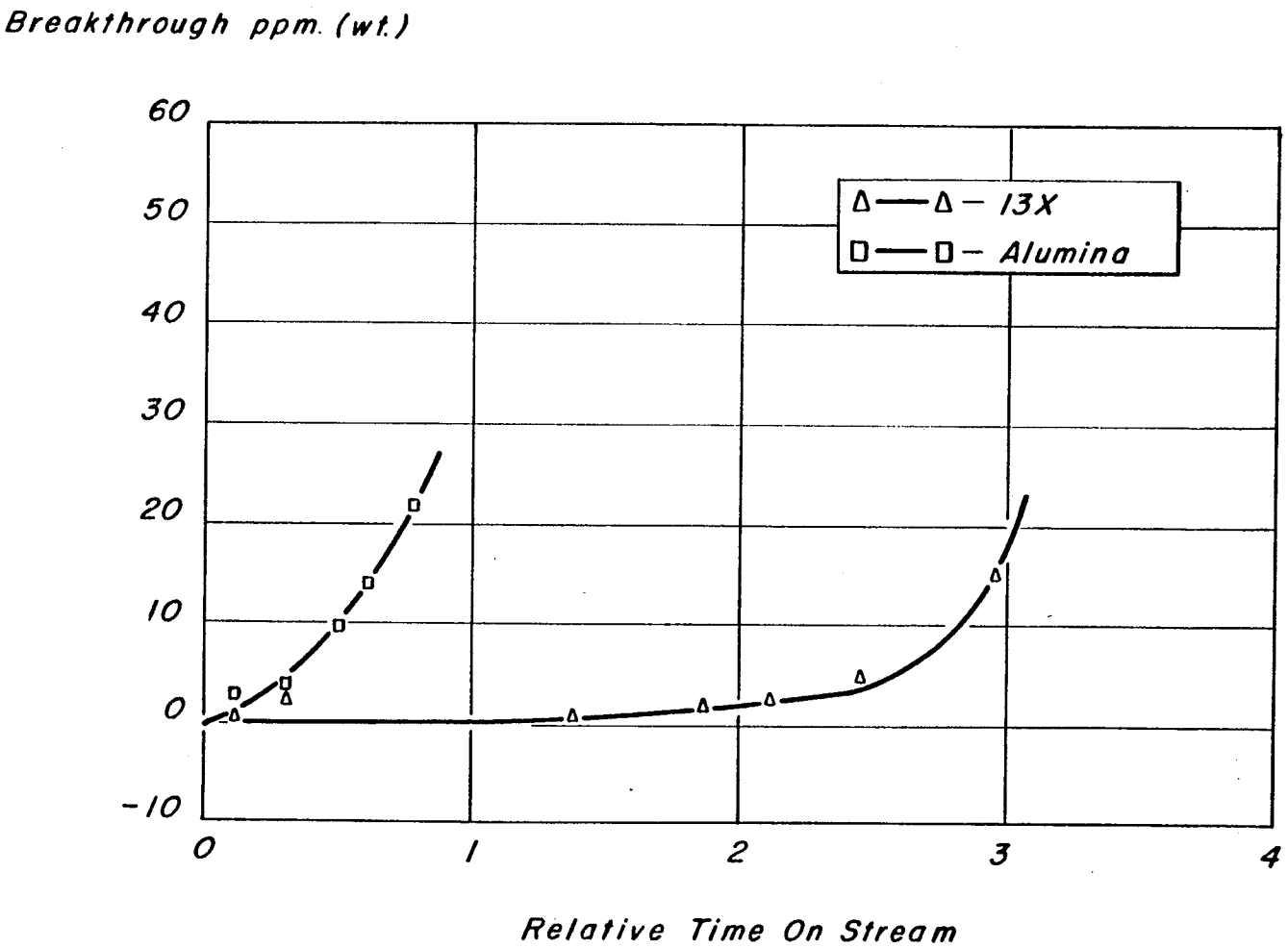
FIG. 2 is a breakthrough curve showing the relative performance in the capacity of 13X zeolite and activated alumina for acetonitrile.

A series of adsorption/regeneration cycles were run in the pilot plant of Example 1 at the conditions of Example 2 to determine the performance capacity of the adsorbent for acetonitrile. The feed concentration during the tests ranged between 35 and 47 wt. ppm acetonitrile. No hydrogen was added to the regeneration gas. FIG. 2 shows the breakthrough concentration curve of acetonitrile by a 13X zeolite compared to an activated adsorbent for a relative time on stream for cycle 32. This demonstrates that after over 30 cycles, the 13X zeolite was shown to have a markedly superior capacity for adsoption of acetonitrile over the activated alumina adsorbent.

We claim:

1. A process for the removal of sulfur compounds including $H_2S$, COS and mercaptan sulfur compounds, and a trace amount of polar compounds comprising acetonitrile or acetone or propionitrile from a hydrocarbon feedstream comprising a $C_3$–$C_5$ product fraction from a fluid catalytic cracking unit comprising the following steps:
   (a) contacting the hydrocarbon feedstream with an alkanolamine in an amine treating zone under $H_2S$ and COS absorption conditions to provide an $H_2S$- and COS-depleted stream;
   (b) contacting the $H_2S$- and COS-depleted stream with an alkaline scrubbing solution in a mercaptan absorption zone under mercaptan sulfur absorption conditions to produce a mercaptan-depleted stream;
   (c) contacting the mercaptan-depleted stream with a polar compound selective adsorbent in an adsorption zone comprising an adsorbent bed containing said adsorbent at adsorption conditions effective to adsorb the trace amount of polar compounds and to produce a treated product stream essentially free of acetonitrile, acetone, and propionitrile;
   (d) recovering the treated product stream;
   (e) contacting the polar compound selective adsorbent in said adsorbent bed with a heated regenerant vapor stream at regeneration conditions to desorb said polar compounds and to provide a spent regenerant vapor stream;
   (f) cooling and condensing the spent regenerant vapor stream to provide a hydrocarbon phase and an aqueous phase;
   (g) removing the aqueous phase comprising said polar compounds; and,
   (h) passing said hydrocarbon phase to an $H_2S$ removal zone to provide a treated hydrocarbon stream and admixing at least a portion of the treated hydrocarbon stream with the regenerant vapor stream.

2. The process of claim 1 wherein said regeneration conditions include a temperature ranging from about 149° C. (300° F.) to about 288° C. (550° F.), and a pressure from about 100 kPa (15 psia) to about 3450 kPa (500 psia).

3. The process of claim 1 further comprising admixing the regenerant vapor stream with hydrogen to provide a hydrogen concentration in excess of about 100 ppm-vol.

4. The process of claim 1 wherein the regenerant vapor stream is selected from the group consisting of propane, normal butane, isobutane, pentanes, a $C_5$ paraffin isomerate, a $C_6$ paraffin isomerate, fuel gas, natural gas, nitrogen, hydrogen and mixtures thereof.

5. The process of claim 1 further comprising:

(a) terminating the passing of the heated regenerant vapor stream to the adsorbent bed;

(b) passing an unheated regenerant to said adsorbent bed to cool said polar compound selective adsorbent and to fill the adsorbent bed with said unheated regenerant;

(c) terminating the flow of the unheated regenerant; and (d) displacing said unheated regenerant in said adsorbent bed with the mercaptan-depleted stream.

6. The process of claim 1 wherein the mercaptan sulfur absorption conditions include a temperature ranging from about 15° C. (60° F.) to about 66° C. (150° F.), and a pressure ranging from about 100 kPa (15 psia) to about 3450 kPa (500 psia).

7. The process of claim 1 wherein the alkanolamine solution in the amine treating zone is selected from the group consisting of monoethanolamine, diethanolamine, methyldiethanolamine and mixtures thereof, and the $H_2S$ and COS absorption conditions are a temperature ranging from about 15° C. (60° F.) to about 66° C. (150° F.) and a pressure ranging from about 100 kPa (15 psia) to about 3450 kPa (500 psia).

8. The process of claim 1 wherein the adsorption conditions effective to adsorb polar compounds are a temperature ranging from about 15° C. (60° F.) to about 66° C. (150° F.) and a pressure ranging from about 100 kPa (15 psia) to about 3450 kPa (500 psia).

9. The process of claim 1 further comprising admixing said treated product with an alcohol, passing the treated product stream and the alcohol to an etherification zone, and recovering an ether product.

10. The process of claim 9 wherein the alcohol comprises methanol, the polar-compound-depleted stream comprises isobutylene and the ether product comprises methyl tertiary butyl ether.

11. The process of claim 1 wherein the polar compound selective adsorbent is zeolite 13X.

12. An alkylation process for the removal of sulfur compounds including $H_2S$, COS and mercaptan sulfur compounds, and a trace amount of polar compounds comprising acetonitrile or acetone or propionitrile from a hydrocarbon feedstream comprising a $C_3$–$C_5$ product fraction from a fluid catalytic cracking unit comprising the following steps:

(a) contacting the hydrocarbon feedstream with an alkanolamine solution in an amine treating zone under $H_2S$ and COS absorption conditions to provide an $H_2S$- and COS-depleted stream;

(b) contacting the $H_2S$- and COS-depleted stream with an alkaline scrubbing solution in a mercaptan absorption zone under mercaptan sulfur absorption conditions to produce a mercaptan-depleted stream and a mercaptide-containing scrubbing solution and contacting said mercaptide-containing scrubbing solution with air or oxygen in the presence of an oxidation catalyst effective to regenerate the mercaptide-containing scrubbing solution;

(c) contacting the mercaptan-depleted stream with a polar compound selective adsorbent in an adsorption zone comprising an adsorbent bed containing said adsorbent at adsorption conditions effective to adsorb said polar compounds to produce a polar-compound-reduced stream;

(d) passing the polar-compound-reduced stream and an isoparaffin stream into an alkylation zone to produce an alkylate product;

(f) regenerating the polar compound selective adsorbent in the adsorption zone by contacting the polar compound selective adsorbent with said heated regenerant vapor stream at regeneration conditions to desorb said polar compounds and to provide a spent regenerant vapor stream;

(g) condensing said spent regenerant vapor stream and recovering a hydrocarbon vapor phase, a hydrocarbon liquid phase and an aqueous phase;

(h) recycling at least a portion of said hydrocarbon vapor phase to provide a portion of said regenerant vapor stream, recovering said hydrocarbon liquid phase and admixing said hydrocarbon liquid stream with said hydrocarbon feedstream; and (i) removing the aqueous phase comprising said polar compounds.

13. The process of claim 12 further comprising the admixing of a small amount of hydrogen with said regenerant vapor to provide a hydrogen concentration in excess of 100 ppm-vol.

14. The process of claim 12 further comprising admixing a portion of the isoparaffin stream with said mercaptan-depleted stream prior to contacting with said polar compound selective adsorbent.

15. The process of claim 12 further comprising passing a portion of said hydrocarbon liquid phase to a stripper to provide a light hydrocarbon stream and a heavier hydrocarbon stream and admixing said heavier hydrocarbon stream with said hydrocarbon feedstream.

16. An etherification process for the removal of sulfur compounds including $H_2S$, COS and mercaptan sulfur compounds, and a trace amount of polar compounds comprising acetonitrile or acetone or propionitrile from a hydrocarbon feedstream comprising a $C_3$–$C_5$ product fraction from a fluid catalytic cracking unit comprising the following steps:

(a) contacting the hydrocarbon feedstream with an alkanolamine solution in an amine treating zone under $H_2S$ and COS absorption conditions to provide an $H_2S$- and COS-depleted stream;

(b) contacting the $H_2S$- and COS-depleted stream with an alkaline scrubbing solution in a mercaptan absorption zone under mercaptan sulfur absorption conditions to produce a mercaptan-depleted stream;

(c) contacting the mercaptan-depleted stream with a polar compound selective adsorbent in an adsorbent zone comprising an adsorbent bed containing said adsorbent at adsorption conditions effective to adsorb the trace amounts of said polar compounds to produce a polar-compound-reduced stream; and (d) passing the polar-compound-reduced stream and an alcohol stream into an etherification zone to produce an ether product;

(e) heating a regenerant stream selected from the group consisting of fuel gas, natural gas, nitrogen and hydrogen to provide a regenerant vapor stream;

(f) regenerating the polar compound selective adsorbent in the adsorption zone by contacting the polar compound selective adsorbent with said regenerant vapor stream at regeneration conditions to desorb said polar compounds and to provide a spent regenerant vapor stream;

(g) condensing said spent regenerant vapor stream and recovering a hydrocarbon phase and an aqueous phase and recycling said hydrocarbon phase to provide a portion of said regenerant vapor stream; and, (h) removing the aqueous phase comprising said polar compounds.

17. The process of claim 16 further comprising recycling a portion of the aqueous phase and admixing said portion of the aqueous phase with the spent regenerant vapor.

18. The process of claim 16 further comprising injecting fresh water into said spent regenerant vapor.

* * * * *